US009134023B2

(12) United States Patent
Boardman et al.

(10) Patent No.: US 9,134,023 B2
(45) Date of Patent: Sep. 15, 2015

(54) COMBUSTOR AND METHOD FOR DISTRIBUTING FUEL IN THE COMBUSTOR

(75) Inventors: Gregory Allen Boardman, Greer, SC (US); Geoffrey David Myers, Simpsonville, SC (US); Hasan Karim, Simpsonville, SC (US); Michael John Hughes, Greer, SC (US); Azardokht Hajiloo, Greer, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 808 days.

(21) Appl. No.: 13/344,690

(22) Filed: Jan. 6, 2012

(65) Prior Publication Data

US 2013/0177858 A1 Jul. 11, 2013

(51) Int. Cl.

| | |
|---|---|
| ***F23R 3/04*** | (2006.01) |
| ***F23C 7/00*** | (2006.01) |
| ***F23R 3/14*** | (2006.01) |
| ***F23R 3/28*** | (2006.01) |

(52) U.S. Cl.

CPC . *F23C 7/004* (2013.01); *F23R 3/14* (2013.01); *F23R 3/286* (2013.01); *F23D 2900/14021* (2013.01)

(58) Field of Classification Search

CPC ..... F23R 3/20; F23R 3/30; F23R 3/36; F23R 3/46; F23R 3/286; F23R 3/346; F23R 2900/00002

USPC ..... 431/12, 284, 285, 349–353; 60/737, 60/747, 733, 738, 739, 746

See application file for complete search history.

(56) References Cited

U.S. PATENT DOCUMENTS

| | | | | | |
|---|---|---|---|---|---|
| 2,565,843 | A | * | 8/1951 | Dennison | 60/747 |
| 3,946,552 | A | * | 3/1976 | Weinstein et al. | 60/743 |
| 3,972,182 | A | * | 8/1976 | Salvi | 60/743 |
| 3,980,233 | A | * | 9/1976 | Simmons et al. | 239/400 |
| 4,215,535 | A | * | 8/1980 | Lewis | 60/736 |
| 4,222,232 | A | * | 9/1980 | Robinson | 60/737 |
| 4,226,083 | A | * | 10/1980 | Lewis et al. | 60/776 |
| 4,262,482 | A | * | 4/1981 | Roffe et al. | 60/736 |
| 4,408,461 | A | * | 10/1983 | Bruhwiler et al. | 60/737 |
| 4,412,414 | A | | 11/1983 | Novick et al. | |
| 4,763,481 | A | * | 8/1988 | Cannon | 60/737 |
| 4,967,561 | A | * | 11/1990 | Bruhwiler et al. | 60/737 |
| 5,121,597 | A | * | 6/1992 | Urushidani et al. | 60/778 |

(Continued)

OTHER PUBLICATIONS

Search Report and Written Opinion from EP Application No. 13150032.4 dated Apr. 19, 2013.

*Primary Examiner* — Jorge Pereiro

(74) *Attorney, Agent, or Firm* — Dority & Manning, PA

(57) ABSTRACT

A combustor includes a plurality of tubes arranged in a tube bundle and supported by at least one plate that extends radially within the combustor, wherein each tube includes an upstream end axially separated from a downstream end and provides fluid communication through the tube bundle. A flow conditioner extends upstream from the upstream end of one or more of the plurality of tubes, and a radial passage extends through the flow conditioner. A method for distributing fuel in a combustor including flowing a working fluid through a flow conditioner that extends from a tube that is configured in a tube bundle comprising a plurality of tubes and that is supported by at least one plate. The flow conditioner includes at least one radial passage to impart radial swirl to the working fluid. Flowing a fuel through an annular insert that is at least partially surrounded by the flow conditioner.

16 Claims, 5 Drawing Sheets

(56) References Cited

U.S. PATENT DOCUMENTS

| | | | | |
|---|---|---|---|---|
| 5,235,814 | A * | 8/1993 | Leonard | 60/738 |
| 5,263,325 | A * | 11/1993 | McVey et al. | 60/738 |
| 5,307,634 | A | 5/1994 | Hu | |
| 5,339,635 | A * | 8/1994 | Iwai et al. | 60/733 |
| 5,373,693 | A * | 12/1994 | Zarzalis et al. | 60/39.23 |
| 5,791,137 | A * | 8/1998 | Evans et al. | 60/39.463 |
| 5,881,756 | A * | 3/1999 | Abbasi et al. | 137/9 |
| 6,016,658 | A | 1/2000 | Willis et al. | |
| 6,331,109 | B1 | 12/2001 | Paikert et al. | |
| 6,539,724 | B2 | 4/2003 | Cornwell et al. | |
| 6,543,235 | B1 * | 4/2003 | Crocker et al. | 60/776 |
| 6,609,376 | B2 * | 8/2003 | Rokke | 60/748 |
| 6,662,564 | B2 * | 12/2003 | Bruck et al. | 60/723 |
| 7,117,677 | B2 * | 10/2006 | Inoue et al. | 60/737 |
| 7,188,476 | B2 * | 3/2007 | Inoue et al. | 60/737 |
| 7,200,998 | B2 * | 4/2007 | Inoue et al. | 60/776 |
| 7,284,378 | B2 * | 10/2007 | Amond et al. | 60/776 |
| 7,313,919 | B2 * | 1/2008 | Inoue et al. | 60/737 |
| 7,343,745 | B2 * | 3/2008 | Inoue et al. | 60/737 |
| 7,469,544 | B2 * | 12/2008 | Farhangi | 60/740 |
| 7,516,607 | B2 * | 4/2009 | Farhangi et al. | 60/39.11 |
| 7,762,074 | B2 * | 7/2010 | Bland et al. | 60/752 |
| 7,841,180 | B2 * | 11/2010 | Kraemer et al. | 60/723 |
| 7,871,262 | B2 * | 1/2011 | Carroni et al. | 431/9 |
| 8,033,112 | B2 * | 10/2011 | Milosavljevic et al. | 60/737 |
| 8,033,821 | B2 * | 10/2011 | Eroglu | 431/9 |
| 8,057,224 | B2 * | 11/2011 | Knoepfel | 431/354 |
| 8,225,591 | B2 * | 7/2012 | Johnson et al. | 60/39.092 |
| 8,225,613 | B2 * | 7/2012 | Sisco et al. | 60/777 |
| 8,234,871 | B2 * | 8/2012 | Davis et al. | 60/737 |
| 8,375,721 | B2 * | 2/2013 | Wilbraham | 60/748 |
| 8,438,851 | B1 * | 5/2013 | Uhm et al. | 60/737 |
| 8,550,809 | B2 * | 10/2013 | Uhm et al. | 431/8 |
| 8,683,804 | B2 * | 4/2014 | Boardman et al. | 60/737 |
| 8,850,820 | B2 * | 10/2014 | Milosavljevic et al. | 60/737 |
| 2002/0083711 | A1 * | 7/2002 | Dean et al. | 60/737 |
| 2006/0021350 | A1 * | 2/2006 | Sanders | 60/743 |
| 2007/0099142 | A1 * | 5/2007 | Flohr et al. | 431/354 |
| 2007/0227148 | A1 * | 10/2007 | Bland et al. | 60/752 |
| 2007/0259296 | A1 * | 11/2007 | Knoepfel | 431/9 |
| 2008/0280239 | A1 * | 11/2008 | Carroni et al. | 431/9 |
| 2009/0173075 | A1 * | 7/2009 | Miura et al. | 60/737 |
| 2009/0293484 | A1 * | 12/2009 | Inoue et al. | 60/740 |
| 2010/0083663 | A1 * | 4/2010 | Fernandes et al. | 60/748 |
| 2010/0186412 | A1 * | 7/2010 | Stevenson et al. | 60/738 |
| 2010/0236247 | A1 * | 9/2010 | Davis et al. | 60/742 |
| 2010/0275601 | A1 * | 11/2010 | Berry et al. | 60/737 |
| 2011/0000215 | A1 * | 1/2011 | Lacy et al. | 60/746 |
| 2012/0279223 | A1 * | 11/2012 | Barker et al. | 60/740 |
| 2013/0101943 | A1 * | 4/2013 | Uhm et al. | 431/8 |

* cited by examiner

COMBUSTOR AND METHOD FOR DISTRIBUTING FUEL IN THE COMBUSTOR

FIELD OF THE INVENTION

The present invention generally involves a combustor and method for distributing fuel in the combustor.

BACKGROUND OF THE INVENTION

Gas turbines are widely used in commercial operations for power generation. Gas turbine combustors generally operate on a liquid and/or a gaseous fuel mixed with a compressed working fluid such as air. The flexibility to run a gas turbine on either fuel provides a great benefit to gas turbine operators.

It is widely known that the thermodynamic efficiency of a gas turbine increases as the operating temperature, namely the combustion gas temperature increases. It is also known that higher combustion gas temperatures may be attained by providing a rich fuel/air mixture in the combustion zone of a combustor. However, higher combustion temperatures resulting from a rich liquid or gaseous fuel/air mixture may significantly increase the generation of nitrogen oxide or NOx, which is an undesirable exhaust emission. In addition, the higher combustion temperatures may result in increased thermal stresses on the mechanical components within the combustor. NOx levels may be reduced by providing a lean fuel/air ratio for combustion or by injecting additives, such as water, into the combustor.

To provide a lean fuel/air mixture the fuel and air may be premixed prior to combustion. The premixing may take place in a dual-fuel combustor fuel nozzle, which may include multiple tubes configured in a tube bundle. As the gas turbine cycles through various operating modes, air flows through the tubes and the fuel is injected into the tubes for premixing with the air. A variety of dual-fuel nozzles exist which allow premixing of a liquid and/or gaseous fuel with a working fluid prior to combustion. However, an improved fuel nozzle and method for supplying fuel to a combustor that improves the uniformity of the fuel mixture would be useful.

BRIEF DESCRIPTION OF THE INVENTION

Aspects and advantages of the invention are set forth below in the following description, or may be obvious from the description, or may be learned through practice of the invention.

One embodiment of the present invention is a combustor that includes a plurality of tubes arranged in a tube bundle and supported by at least one plate that extends radially within the combustor, wherein each tube includes an upstream end axially separated from a downstream end and provides fluid communication through the tube bundle. A flow conditioner that extends upstream from the upstream end of one or more of the plurality of tubes, and a radial passage that extends through the flow conditioner.

Another embodiment of the present invention is a combustor that includes a plurality of tubes arranged in a tube bundle and supported by at least one plate that extends radially within the combustor, wherein each tube includes an upstream end axially separated from a downstream end and provides fluid communication through the tube bundle. A flow conditioner that extends upstream from the upstream end of one or more of the plurality of tubes, and an annular insert that is at least partially surrounded by the flow conditioner and includes a downstream end.

The present invention may also include a method for distributing fuel in a combustor that includes flowing a working fluid through a flow conditioner that extends upstream from an upstream end of a tube configured in a tube bundle that includes a plurality of tubes and that is supported by at least one plate. The flow conditioner includes at least one radial passage to impart radial swirl to the working fluid. The method also includes flowing a fuel through an annular insert that is at least partially surrounded by the flow conditioner.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
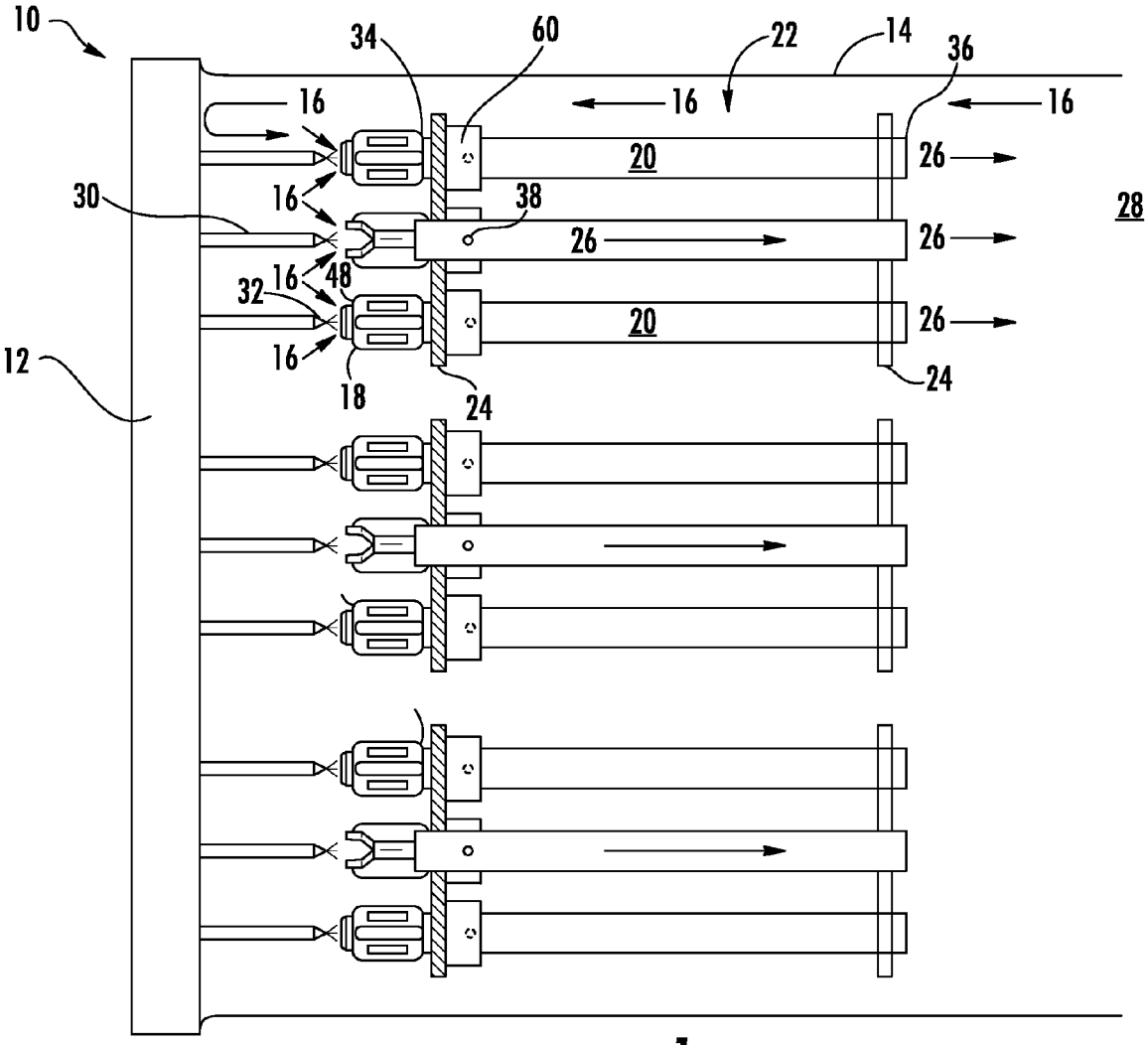
FIG. 1 is a simplified cross-section view of an exemplary combustor according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. As used herein, the terms "upstream" and "downstream" refer to the relative location of components in a fluid pathway. For example, component A is upstream from component B if a fluid flows from component A to component B. Conversely, component B is downstream from component A if component B receives a fluid flow from component A.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Various embodiments of the present invention include a combustor and method for distributing fuel in the combustor. The combustor generally includes a plurality of tubes configured in a bundle formed by at least one plate. The tubes generally allow a gaseous and/or liquid fuel and a working fluid to thoroughly mix before entering a combustion chamber. In particular embodiments, the combustor may also include a flow conditioner for imparting radial swirl to the working fluid as it enters the tubes to enhance mixing of the working fluid and the fuel. In another embodiment, the combustor may further include an annular insert at least partially surrounded by the flow conditioner. Although exemplary embodiments of the present invention will be described generally in the context of a combustor incorporated into a gas turbine for purposes of illustration, one of ordinary skill in the art will readily appreciate that embodiments of the present invention may be applied to any combustor and are not limited to a gas turbine combustor unless specifically recited in the claims.

Figure 4:
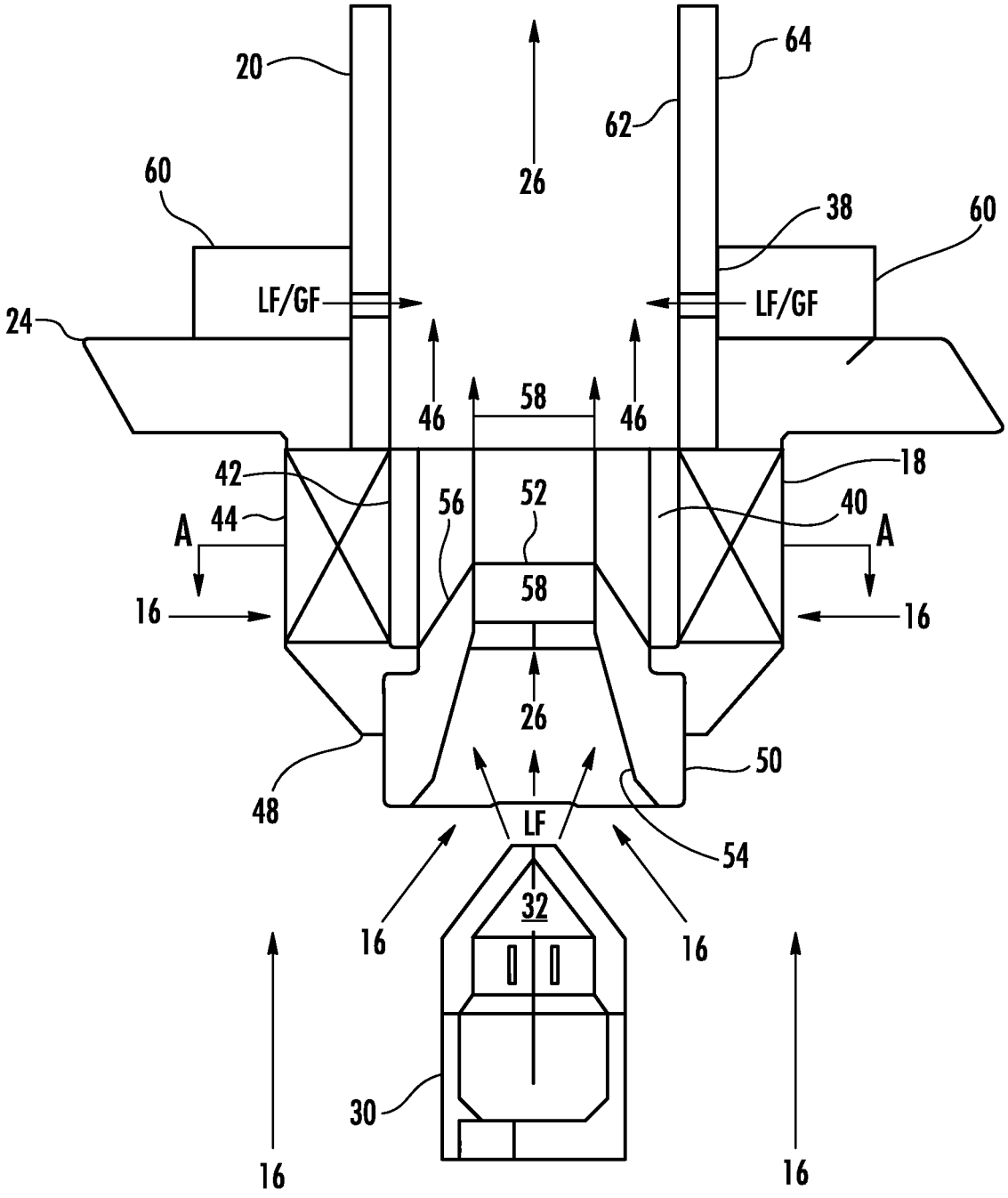
FIG. 4 is an enlarged cross section view of a single tube of the combustor as shown in FIG. 1.

FIG. 1 shows a simplified cross-section view of an exemplary combustor 10, such as would be included in a gas turbine and according to one embodiment of the present invention, and FIG. 4 provides an enlarged cross section view of a single tube of the combustor as shown in FIG. 1. An end cover 12 and a casing 14 may surround the combustor 10 to contain a working fluid 16, such as air, flowing to the combustor 10. When the working fluid 16 reaches the end cover 12, the working fluid 16 may reverse direction and may flow through a flow conditioner 18 extending upstream from at least one of a plurality of tubes 20 generally configured in one or more tube bundles 22 and supported at least one plate 24 extending generally radially within the combustor 10. As shown in FIGS. 1 and 4, the flow conditioner 18 may include an annular insert 50 including a downstream end 52 that may be at least partially surrounded by the flow conditioner 18 and may be generally concentric with the flow conditioner 18. As shown in FIG. 4, the annular insert may include an inner surface 54 radially separated by an outer surface 56. The annular insert 50 may provide fluid communication from the combustor 10, through the flow conditioner 18 and into at least one of the plurality of tubes 20.

As shown in FIG. 1, the combustor 10 may also include one or more conduits 30. The one or more conduits 30 may be in fluid communication with the end cover 12 and may be configured to flow a liquid fuel LF or gaseous fuel GF. The one or more conduits 30 may generally extend downstream from the end cover 12 and may provide fluid communication between the end cover 12 and one or more of the plurality of tubes 20 and/or the annular insert 50. In particular embodiments, an atomizer 32 may extend from the one or more conduits 30 and may provide an at least partially vaporized spray of the liquid fuel LF to the combustor 10. Generally, the atomizer 32 may inject liquid fuel, emulsion, or gaseous fuel into the combustor 10 and/or into one or more of the plurality of tubes 20.

As shown in FIG. 1, each tube 20 in the plurality of tubes 20 may include an upstream end 34 axially separated from a downstream end 36 and may provide fluid communication through the one or more tube bundles 22. As shown in FIGS. 1 and 4, each tube may include a tube inner surface 62 and a tube outer surface 64. In particular embodiments, as shown in FIGS. 1 and 4, one or more of the plurality of tubes 20 may define one or more fuel ports 38 extending radially through one or more of the plurality of tubes 20. The one or more fuel ports 38 may be positioned between the upstream end 34 and the downstream end 36 of one or more of the plurality of tubes 20.

The one or more fuel ports 38 may be at least partially surrounded by at least one fuel plenum 60, and the one or more fuel ports 38 may provide fluid communication between the fuel plenum 60 and one or more of the plurality of tubes 20. The fuel plenum may be adapted to provide the gaseous fuel GF and/or the liquid fuel LF. The one or more fuel ports 38 may be angled radially, axially, and/or azimuthally to project and/or impart swirl to the liquid or gaseous fuel and/or the working fluid 16 flowing through the one or more fuel ports 38 and into one or more of the plurality of tubes 20. In this manner, the liquid fuel LF and/or gaseous fuel GF may flow through the one or more fuel ports 38 and into one or more of the plurality of tubes 20 to mix with the working fluid 16, thus providing a fuel-working fluid mixture 26 within one or more of the plurality of tubes 20. As a result, the fuel-working fluid mixture 26 may then flow through one or more of the plurality of tubes 20 and into the combustion zone 28, as shown in FIG. 1.

Figure 2:
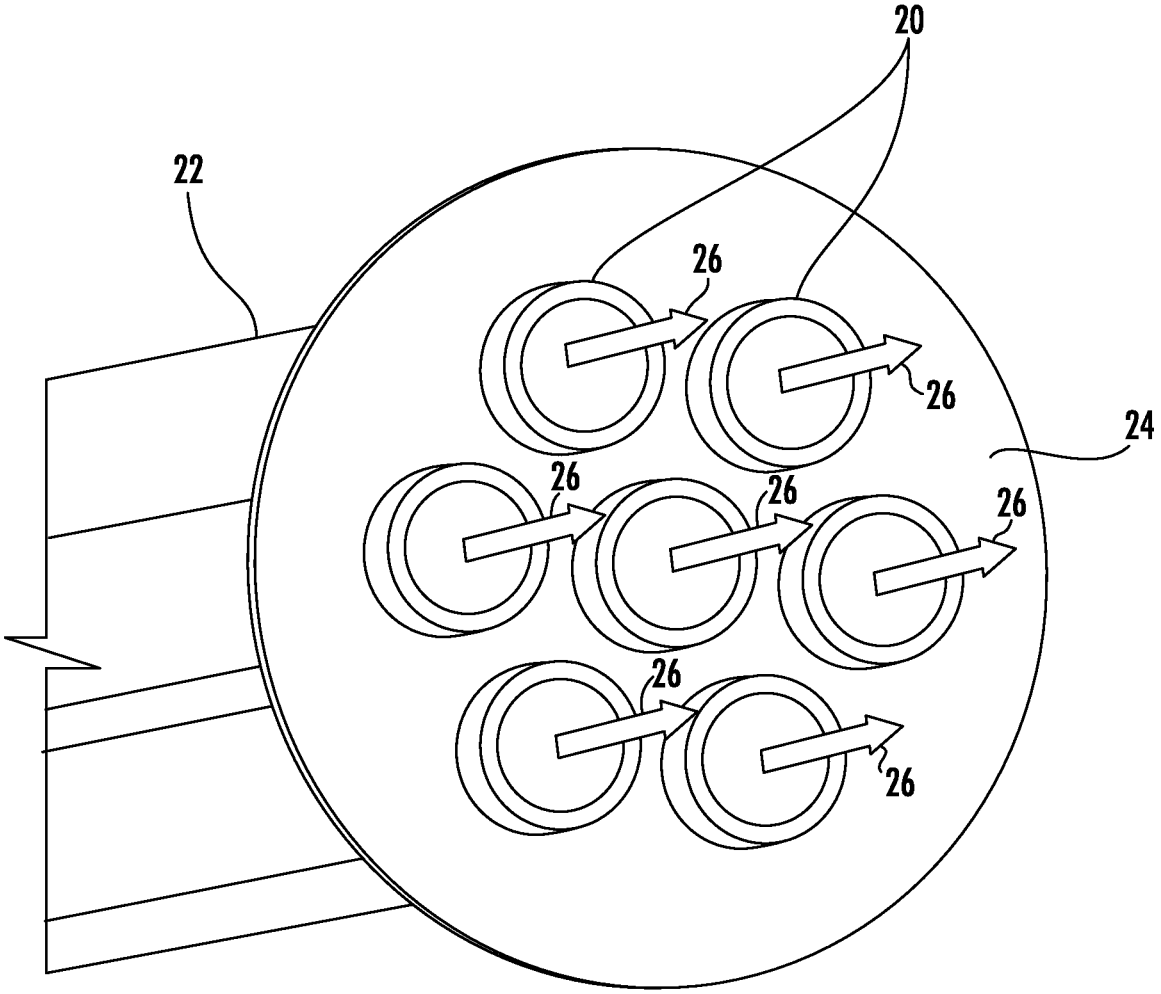
FIG. 2 is an enlarged perspective upstream view of a tube bundle as shown in FIG. 1.

FIG. 2 is an enlarged perspective upstream view of a tube bundle 22 as shown in FIG. 1. As shown in FIGS. 1 and 2, the plurality of tubes 20 may be arranged in one or more tube bundles 22 and may be held in position by at least one plate 24. As shown in FIG. 2, the plurality of tubes 20 may be arranged in a circular pattern. However, the particular shape, size, and number of tubes 20 and tube bundles 22 may vary according to particular embodiments. For example, the plurality of tubes 20 are generally illustrated as having a cylindrical shape; however, alternate embodiments within the scope of the present invention may include one or more of the plurality of tubes 20 having virtually any geometric cross-section. Similarly, the combustor 10 may include a single tube bundle 22 that extends radially across the entire combustor 10, or the combustor 10 may include multiple circular, triangular, square, oval, or pie-shaped tube bundles 22 in various arrangements in the combustor 10. One of ordinary skill in the art will readily appreciate that the shape, size, and number of tubes 20 and tube bundles 22 is not a limitation of the present invention unless specifically recited in the claims.

Figure 3:
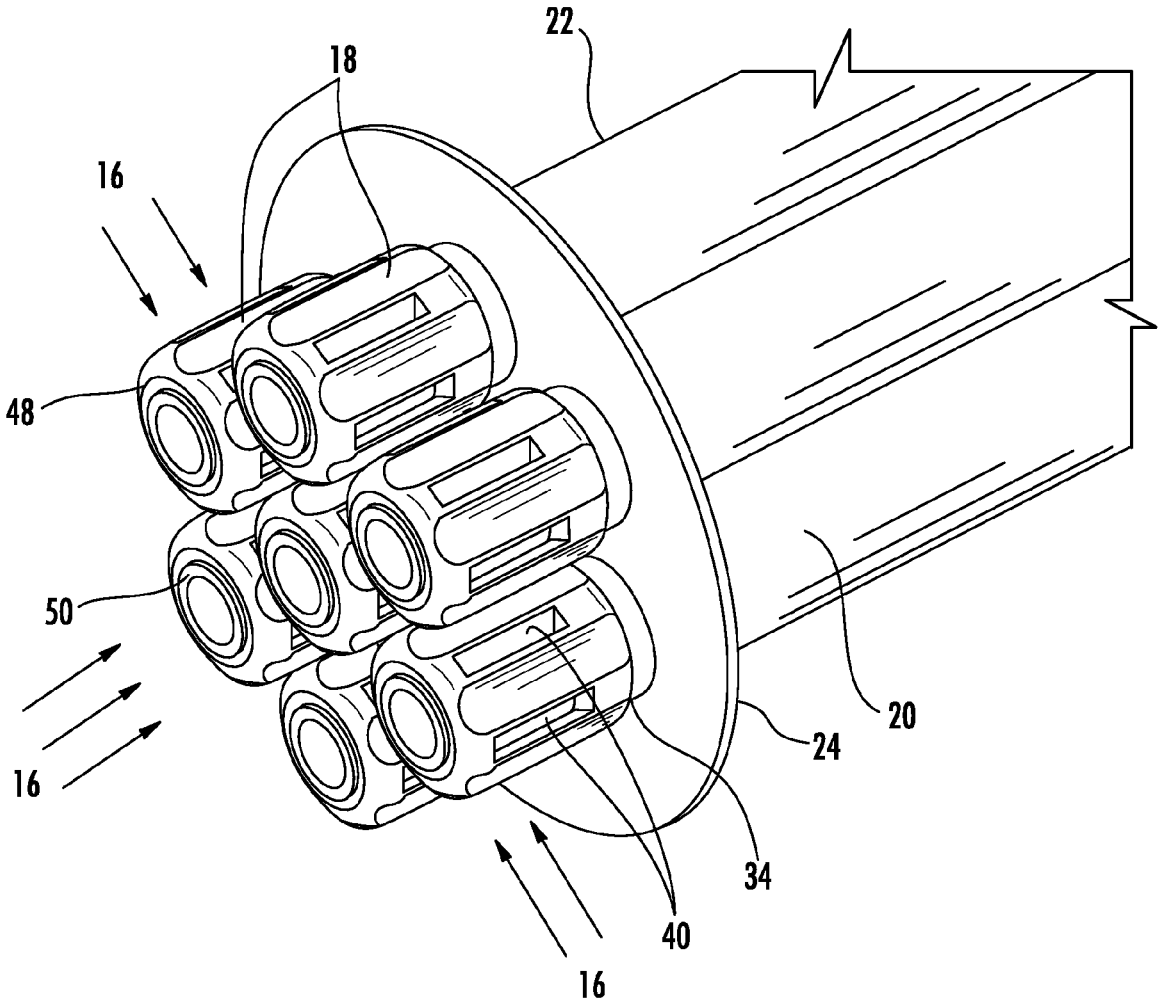
FIG. 3 is an enlarged perspective downstream view of a tube bundle as shown in FIG. 1.
Figure 5:
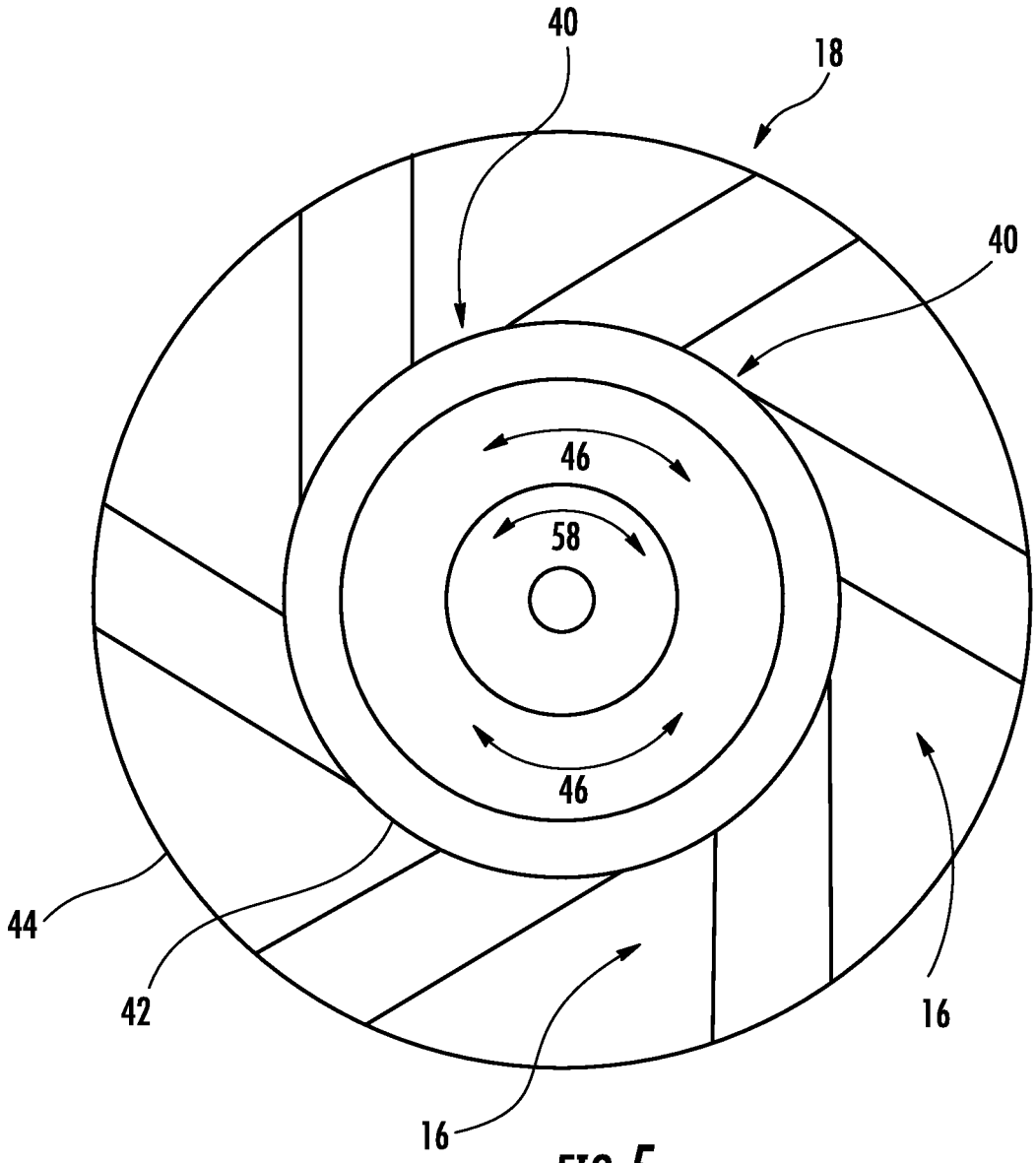
FIG. 5 is an enlarged cross section view of the single tube taken along line A-A as shown in FIG. 4.

FIG. 3 is an enlarged perspective downstream view of a tube bundle 22 as shown in FIG. 1, and FIG. 5 is an enlarged cross section view of the one of the plurality of tubes 20 taken along line A-A as shown in FIG. 4. As shown in FIG. 3, the flow conditioner 18 may extend generally upstream from the upstream end 34 of one or more of the plurality of tubes 20, and the flow conditioner may include an upstream surface 48. As shown in FIGS. 4 and 5, the flow conditioner 18 may include one or more radial passages 40 extending through the flow conditioner 18. As shown in FIG. 5, the one or more radial passages 40 may be angled to impart radial swirl to the working fluid 16 as it flows through the one or more radial passages 40 and into the flow conditioner 18.

In particular embodiments, at least one of the one or more radial passages 40 may be configured to impart radial swirl in a first direction, for example, clockwise, and a second radial passage 40 may be configured to impart radial swirl in a second direction, for example, counter clockwise. The one or more radial passages 40 may be of equal flow areas, or may be of varying flow areas. In this manner, a flow rate of the working fluid through the one or more radial passages 40 and/or the amount of swirl may be controlled in individual flow conditioners 18 throughout the combustor 10. The flow conditioners 18 may further include a flow conditioner inner surface 42 and a flow conditioner outer surface 44. A radial flow region 46 may be defined by the flow conditioner inner surface 42 and the annular insert 50 outer surface 56, and may provide fluid communication through the flow conditioner 18 and into one or more of the plurality of tubes 20. In this manner, as the working fluid 16 enters the flow conditioner 18 through the one or more radial passages 40, the working fluid may prevent the liquid fuel LF and/or the gaseous fuel GF from contacting and/or filming along the tube inner surface 62 of one or more of the plurality of tubes 20. As a result, a more thoroughly mixed fuel-working fluid mixture 26 may be provided for combustion. In addition, the possibility of flame holding or flashback may be decreased at the downstream surface 36 of one or more of the plurality of tubes 20.

As shown in FIGS. 3 and 4, the annular insert 50 inner surface 54 and outer surface 56 may generally define an axial flow region 58 through the annular insert 50. The axial flow region 58 may extend generally downstream from the annular insert downstream end 52. In this manner, the axial flow region 58 may prevent a central recirculation zone from forming and/or may enhance shear fuel-working fluid mixing within one or more of the plurality of tubes 20. In particular embodiments, the annular insert 50 downstream surface 52 may terminate at a point. For example, a sharp or knife-edge may formed along the downstream surface 52 at the termination point. In particular embodiments, the annular insert 50 inner surface 54 may converge radially inward and/or radially outward towards the downstream end 52 of the annular insert 50. In particular embodiments, the annular insert 50 outer surface 56 may converge radially inward towards the annular insert downstream end 52 and may further define the radial flow region 40 between the annular insert outer surface 54 and the flow conditioner inner surface 42. In specific embodiments, the annular insert inner surface 56 may include at least one of protrusions, groves and vanes to impart axial swirl to the working fluid 16 as it flows through the axial flow region 58.

In particular embodiments of the present invention, the working fluid 16 may enter the radial flow region 46 through the annular insert 50 and/or the one or more radial passages 40 and the gaseous fuel GF may be injected through the one or more fuel ports 38. In this manner, the working fluid 16 may mix with the gaseous fuel GF to provide the pre-mixed fuel-working fluid mixture 26 for combustion in the combustion zone 28. As a result, the gaseous fuel GF and working fluid 16 mixing may be enhanced and may allow for shorter tubes 20 with larger diameters, thereby reducing the number of individual tubes 20 required per tube bundle 22, thus reducing overall combustor 10 weight and costs. In addition, as the fuel-working fluid mixture 26 exits the downstream end 36 of one or more of the plurality of tubes 20, the swirling mixture may enhance turbulent mixing between hot combustion products and fresh reactants in the combustion zone 28, thus enhancing combustion flame stability. As a result, a greater range of operability may be provided for less reactive gaseous fuels, such as methane.

In alternate embodiments, as shown in FIG. 4, the liquid fuel LF may be injected through the atomizer 32 and into the annular insert 50 axial flow region 58. At least a portion of the liquid fuel LF may mix with the working fluid 16 as it enters the annular insert 50. However, the remaining liquid fuel LF may pre-film along the annular insert 50 inner surface 54. As the fuel-working fluid mixture 26 drives the pre-filmed liquid fuel LF downstream and across the sharp edge of the downstream end 52 of the annular insert 50, at least a portion of the pre-filmed fuel may vaporize into a fine mist and may more efficiently mix with the working fluid flowing through the axial flow region and/or the working fluid 16 from the radial flow region 46. In this manner, fuel and working fluid premixing may be greatly enhanced, thus reducing the usage of additives in a combustor 10, such as water, generally necessary to achieve desired NOx levels. In addition, the annular insert inner surface 54 may provide a barrier between the radial flow region 46 and the liquid fuel LF, thus decreasing the likelihood of the liquid fuel LF attaching to the tube inner surface 62 of one or more of the plurality of tubes 20.

The various embodiments shown and described with respect to FIGS. 1-5 may also provide a method for distributing the liquid fuel LF and/or the gaseous fuel GF in the combustor 10. For example, the method may include flowing a working fluid through the flow conditioner 18 extending upstream from an upstream end 34 of a tube 20 configured in a tube bundle 22 comprising a plurality of tubes 20 and supported by at least one plate 24. The flow conditioner 18 may include at least one radial passage 40 to impart radial swirl to the working fluid 16. The method may further include flowing a fuel through the annular insert 50 that is at least partially surrounded by the flow conditioner 18. The method may further include flowing the fuel and the working fluid 16 across the downstream end 52 of the annular insert 50. The method may further include injecting the gaseous fuel GF through the fuel port 38, and mixing the working fluid 16 and gaseous fuel GF within one or more of the plurality of tubes 20, and flowing the fuel-working fluid mixture 26 through one or more of the plurality of tubes 20 and into the combustion zone 28. The method may further include, imparting a first radial swirl in a first direction in a first flow conditioner 18, and imparting a second radial swirl in a second direction in a second flow conditioner 18. The method may also include, flowing the working fluid 16 through the flow conditioners 18 and/or through the annular insert 50 and injecting the liquid fuel LF into the annular insert 50. The method may further include mixing the working fluid 16 with the liquid fuel LF inside the annular insert 50, and pre-filming the liquid fuel LF along the annular insert inner surface 54. The method may further include vaporizing the liquid fuel LF as it flows downstream of the annular insert downstream end 52. The method may further include imparting a radial swirl to the working fluid 16 entering the radial flow region 46 and shearing the vaporized liquid fuel LF as it flows across the annular insert downstream end 52.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other and examples are intended to be within the scope of the claims if they include structural elements that do not differ from the literal language of the claims, or if they include equivalent structural elements with insubstantial differences from the literal languages of the claims.

What is claimed is:

1. A combuster, comprising:

a. a plurality of tubes arranged in a tube bundle and supported by at least one plate extending radially within the combustor, wherein each tube includes an upstream end axially separated from a downstream end and a fuel port defined by the tube between the upstream end and the downstream end, wherein the fuel port provides for fluid communication into the tube, wherein each tube extends parallel to an adjacent tube of the plurality of tubes;

b. a first flow conditioner that extends upstream from the upstream end of a first tube of the plurality of tubes, wherein the first flow conditioner defines a plurality of radial passages annularly arranged thereabout, wherein the first flow conditioner provides for a first flow rate of a compressed working fluid through the first tube;

c. a second flow conditioner that extends upstream from the upstream end of a second tube of the plurality of tubes, wherein the second flow conditioner defines a plurality of radial passages annularly arranged thereabout, wherein the second flow conditioner provides for a second flow rate of a compressed working fluid through the second tube;

d. a first liquid fuel atomizer disposed upstream from an inlet of the first flow conditioner:

e. a second liquid fuel atomizer disposed upstream from an inlet of the second flow conditioner; and f. a fuel plenum that circumferentially surrounds the tubes, wherein each fuel port is in fluid communication with the fuel plenum.

2. The combustor of claim 1, wherein the radial passages of the first flow conditioner and the radial passages of the second flow conditioner are angled to impart radial swirl to a compressed working fluid flowing therethrough.

3. The combustor as in claim 1, wherein the plurality of radial passages of the first flow conditioner directs a working fluid in a first angular direction and the plurality of radial passages of the second flow conditioner directs the working fluid in a second angular direction.

4. The combustor of claim 1, wherein the plurality of radial passages of the first flow conditioner defines varying flow areas through a main body of the first flow conditioner.

5. The combustor of claim 1, further comprising:

a first annular insert, concentrically aligned within and fixedly connected to the first flow conditioner, wherein an outer surface of the first annular insert and the inner surface of the first flow conditioner define a radial flow region within the first flow conditioner and an inner surface of the first annular insert defines an axial flow region within the flow conditioner; and a second annular insert concentrically aligned within and fixedly connected to the second flow conditioner, wherein an outer surface of the second annular insert and the inner surface of the second flow conditioner define a radial flow region within the second flow conditioner and an inner surface of the second annular insert defines an axial flow region within the flow conditioner.

6. The combustor of claim 5, wherein at least one of the first annular insert or the second annular insert imparts axial swirl to the working fluid.

7. The combustor of claim 5, wherein at least one of the first annular insert or the second annular insert includes an inner surface and an outer surface, wherein the inner surface converges radially inwardly towards the downstream end of the respective first annular insert or the second annular insert.

8. The combustor of claim 5, wherein at least one of the first annular insert or the second annular insert includes an inner surface and an outer surface, wherein the inner surface diverges radially outwardly towards the downstream end of the respective first annular insert of the second annular insert.

9. The combustor of claim 5, wherein at least one of the first annular insert or the second annular insert includes an inner surface and an outer surface, wherein the outer surface converges radially inwardly towards the downstream end of the respective first annular insert or the second annular insert.

10. A combustor, comprising:

a. a plurality of tubes arranged in a tube bundle and supported by at least one plate extending radially within the combustor, wherein each tube includes an upstream end axially separated from a downstream end, wherein each tube includes a fuel port between the upstream end and the downstream end of the tube, wherein the fuel port provides for fluid communication in to the tube;

b. a fuel plenum that circumferentially surrounds the tubes between the upstream end and the downstream ends of the tubes, wherein each fuel port is in fluid communication with the fuel plenum;

c. a plurality of flow conditioners, each flow conditioner extending upstream from the upstream end of a corresponding tube of the plurality of tubes, each flow conditioner having an inner surface, wherein each flow conditioner defines a plurality of radial passages annularly arranged thereabout;

d. a first annular insert concentrically aligned within and fixedly connected to a first flow conditioner of the plurality of flow conditioners, wherein an outer surface of the first annular insert and the inner surface of the first flow conditioner define a radial flow region within the first flow conditioner and an inner surface of the first annular insert defines an axial flow region within the flow conditioner;

e. a second annular insert concentrically aligned within and fixedly connected to a second flow conditioner of the plurality of flow conditioners, wherein an outer surface of radial flow region within the second flow conditioner and an inner surface of the second annular insert defines an axial flow region within the flow conditioner, wherein the first annular insert provides a first flow rate and the second annular insert provides a second flow rate through the first and second tubes respectfully; and f. a liquid fuel atomizer disposed upstream from an inlet of the annular insert.

11. The combustor of claim 10, wherein the first annular insert and the second annular insert each define a downstream end that terminates at a sharp edge.

12. The combustor of claim 10, wherein an inner surface of the first annular insert converges radially inwardly towards a downstream end of the first annular insert.

13. The combustor of claim 10, wherein an outer surface of the first annular insert diverges radially outwardly towards a downstream end of the first annular insert.

14. The combustor of claim 10, wherein the first annular insert extends axially upstream of the first flow conditioner and the second annular insert extends axially upstream from the second flow conditioner.

15. The combustor of claim 10, wherein an inner surface of the second annular insert converges radially inwardly towards a downstream end of the second annular insert.

16. The combustor of claim 10, wherein an outer surface of the second annular insert diverges radially outwardly towards a downstream end of the second annular insert.

* * * * *